United States Patent [19]

Filhaber

[11] 3,983,314

[45] Sept. 28, 1976

[54] DEAD FRONT MULTI-TAP TERMINAL CONNECTOR CASING

[75] Inventor: Ilmar J. Filhaber, Poughkeepsie, N.Y.

[73] Assignee: Fargo Mfg. Company, Inc., Poughkeepsie, N.Y.

[22] Filed: Aug. 1, 1975

[21] Appl. No.: 601,159

[52] U.S. Cl. ..... 174/138 F; 339/272 A

[51] Int. Cl.[2] ..... H01R 13/44

[58] Field of Search..... 174/5 R, 72 R, 138 F; 339/36, 116 R, 116 C, 198 J, 213 R, 242, 272 R, 272 A

[56] References Cited

OTHER PUBLICATIONS

*Electrical World*, Sept. 15, 1973, p. 203.

*Primary Examiner*—Laramie E. Askin

[57] ABSTRACT

A casing for conveniently and safely covering and insulating a transformer multi-tap terminal connector includes an elongated main body portion having an open side and an elongated panel attached to the main body portion at the open side to define with the body portion a hollow tubular member. Front and rear covers are attached to the ends of the tubular member. A plurality of openings are provided through the elongated panel through which conductors can be passed for connection to a multi-tap terminal connector to be covered by the casing; and a resilient non-conducting cushion having through openings aligned with the openings in the panel is positioned within the casing to prevent collapse of the panel when conductors are inserted through the openings thereof. The main body portion also has holes located at right angles to the openings in the panel for receiving a tool to manipulate the screws of the multi-tap connector, and these holes are closed by a slidably mounted lid.

3 Claims, 5 Drawing Figures

DEAD FRONT MULTI-TAP TERMINAL CONNECTOR CASING

BACKGROUND OF THE INVENTION

In providing an electric service in a community, pad mounted transformers are frequently used. Such a transformer is contained in a box or casing on a pad usually on the ground. The primary connection to the transformer is usually underground with provision made for tapping off secondary outlets on the transformer. The secondary terminal positions are usually three and each can provide for any number of taps.

The transformer is supplied with a copper terminal, either a bar with holes or threaded stud which projects through a terminal provided in the transformer casing to allow for a tap of the bar or stud.

It is necessary to tap off the stud through use of a suitable connector and then insulate the tap. The subject invention provides a dead front multi-tap terminal connector casing which is easy and provides the necessary insulation.

SUMMARY OF THE INVENTION

A terminal connector casing including in combination an elongated body, an open side formed in the body throughout its length, a plurality of through holes provided in the body and disposed in alignment longitudinally thereof, an elongated panel for attachment to the body in the zone of the open side to provide with the body a hollow tubular member, means are provided for attaching the panel to the body at the longitudinal edges thereof, a plurality of openings in the panel disposed in alignment longitudinally thereof with each opening in the respective transverse plane of one of the through holes, front and rear cover members attached to the tubular member at either end thereof and a lid slidably attached thereto so that by manipulation of the lid the through holes can be simultaneously covered or exposed to view.

DESCRIPTION OF THE PREFERRED EMBODIMENTS

Figure 1:
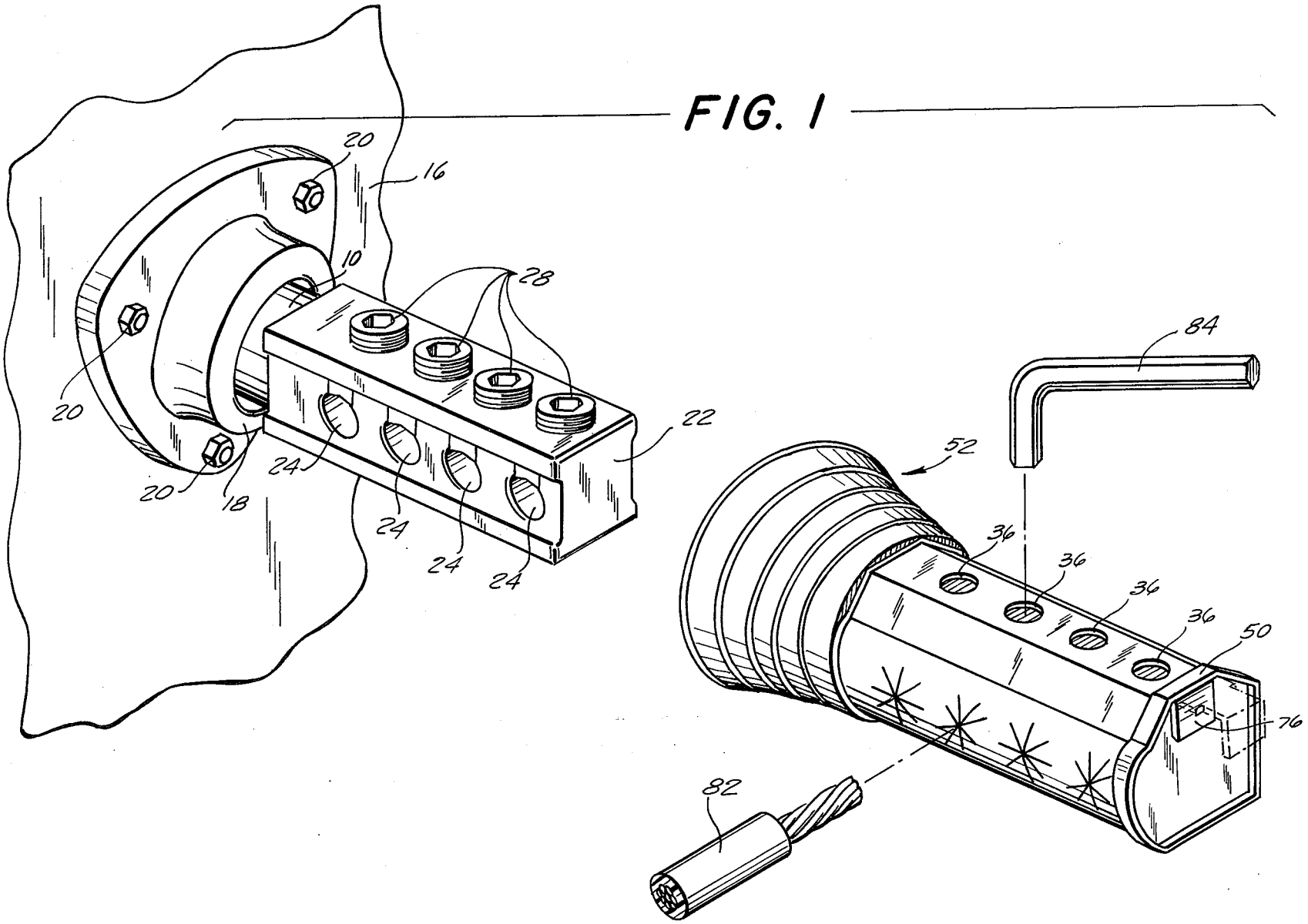
FIG. 1 is an exploded perspective view of a dead front multi-tap terminal connector with a casing which is constructed in accordance with the teachings of this invention and a wrench and tap conductor shown.
Figure 3:
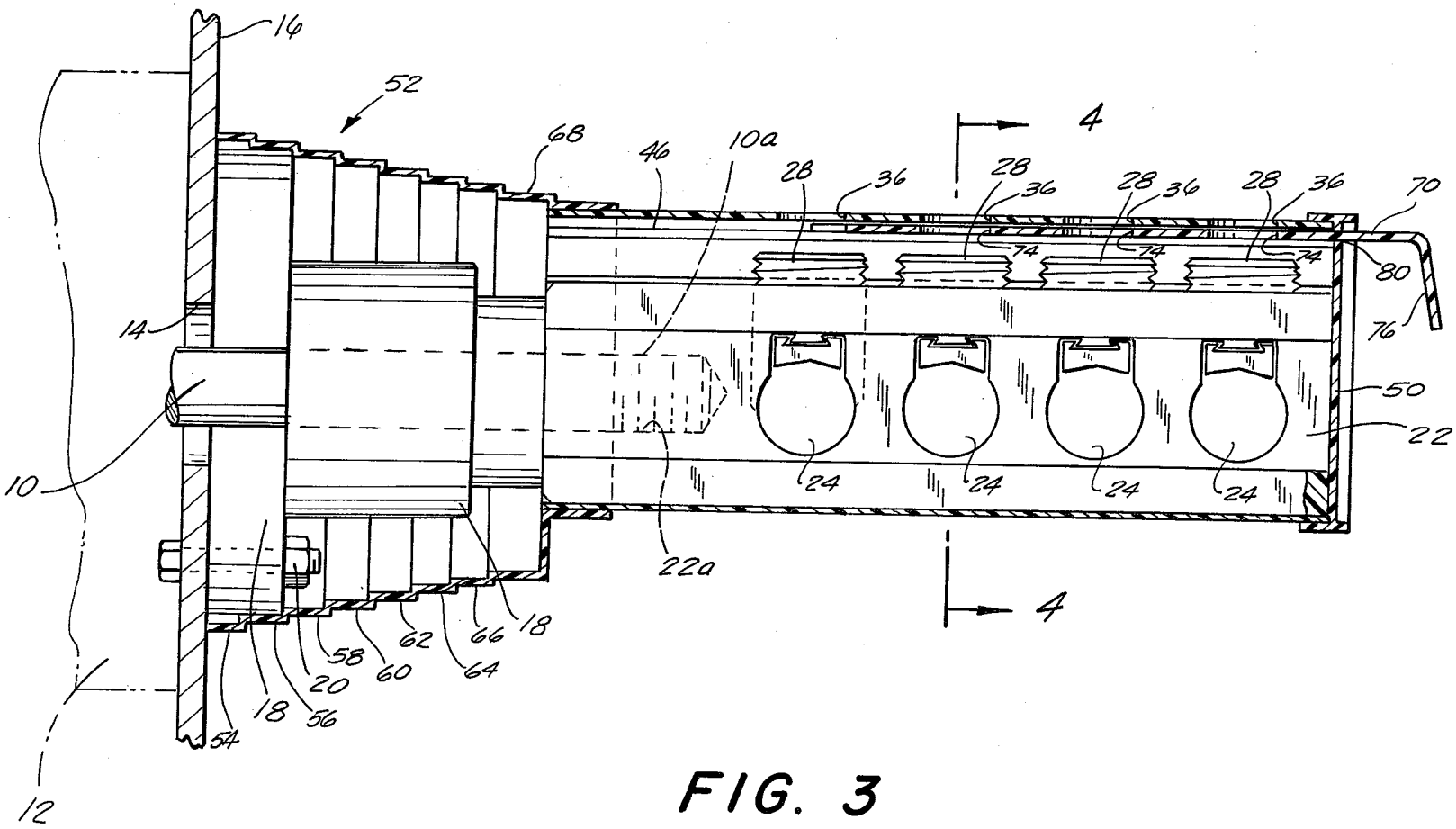
FIG. 3 is a longitudinal sectional view of the connector and casing which is shown in FIG. 1 illustrated in position in an installation.

In FIGS. 1 and 3 stud 10 of transformer 12 is shown passing through opening 14 in casing 16 of the transformer and through terminal 18 affixed to casing 16 by bolts 20. The stud 10 which is usually formed of copper is supplied with a transformer and projects outwardly through the insulating terminal so that multi-tap electrically conductive connector 22 can be attached thereto by screwing onto the threaded end 10*a* of the stud by means of threaded insert 22*a* formed in the connector.

Connector 22 is a well known and commonly used elongated member which is provided with a plurality of tap conductor receiving holes 24 each of which lies in the transverse plane of a screw receiving threaded hole 26 with which it intersects. Each of the holes 26 has a screw 28 therein for fastening the ends of a tap conductor in a hole 24 providing a firm mechanical and electrical connection. The screws 28 shown herein have allen heads, however other types of screws can be utilized.

The terminal casing is a protective vinyl casing which in the preferred embodiment is formed of polyvinyl chloride. The casing is in the form of an elongated body having sides 29, 30 and 32 with side 34 an open side which is formed in the casing body throughout its length. A plurality of through holes 36 are provided in side 29 disposed in alignment longitudinally thereof. Sides 30 and 32 are substantially rectangular. An elongated panel 38 is provided for attachment to the body in the zone of the open side 34 and to close that side and to form with the casing body a hollow tubular member. Means are provided for attaching panel 38 to the body at the longitudinal edges thereof. Such means includes outwardly open channels 40 and 42 formed along the long edges of panel 38 which channels respectively receive therein extensions 44 and 46 of sides 32 and 29 of the body which extend along the edges of open side 34. The extensions are received in the channels by means of a sliding fit.

A plurality of openings 48 are provided in the panel 38 by cut lines enabling such openings to be formed in the field by pushing the end of a tap conductor therethrough. When panel 38 is in position on the body the openings 48 are disposed in alignment longitudinally thereof with each opening in the respective transverse plane of one of said through holes 36.

A foam rubber cushion 45 having openings 47 which are respectively aligned in assembled condition with openings 48 is provided to prevent the shell 38 from collapsing when a conductor is inserted through openings 48 as will be explained below and to provide improved sealing. Cushion 45 is contoured to conform to the inner surface of panel 38 with rear portion 49 projecting between channel forming portions 40' and 42' of panel 38 with edges 45*a* and 45*b* respectively held in position thereby.

A front cover 50 is provided for fitting over one open end of the body. A rear cover in the form of bushing 52 is provided having a plurality of different sized transverse zones 54, 56, 58, 60, 62, 64 and 66. The portion 54 is the largest and provided for fitting over or overlying the insulating member 18 in which shape it is formed and the remaining portions 56 through 66 are provided to enable member 52 to be sectioned or sliced to fit precisely in position over the particular insulating terminal involved. Portion 68 thereof is formed to receive the end of the body therein so that with front cover 50 rear cover 52 terminates or closes either end of the body.

A lid 70 is provided which is slidably attached to the body having the edges 70*a* and 70*b* thereof received within facing channels 72*a* and 72*b* respectively.

Lid 70 is slidably received within the channels so formed in the body and has through holes 74 corresponding to holes 36 so that in the closed position of the lid, namely, when tab 76 thereof is adjacent end 50, the holes 36 are closed; however, in an open position of the lid holes 36 are exposed in turn exposing the holes 26 and screws 28 therein. The lid at the tab thereof has shoulders 78 which engage slot 80 in cover 52 to maintain the lid in position when it is closed.

Figure 2:
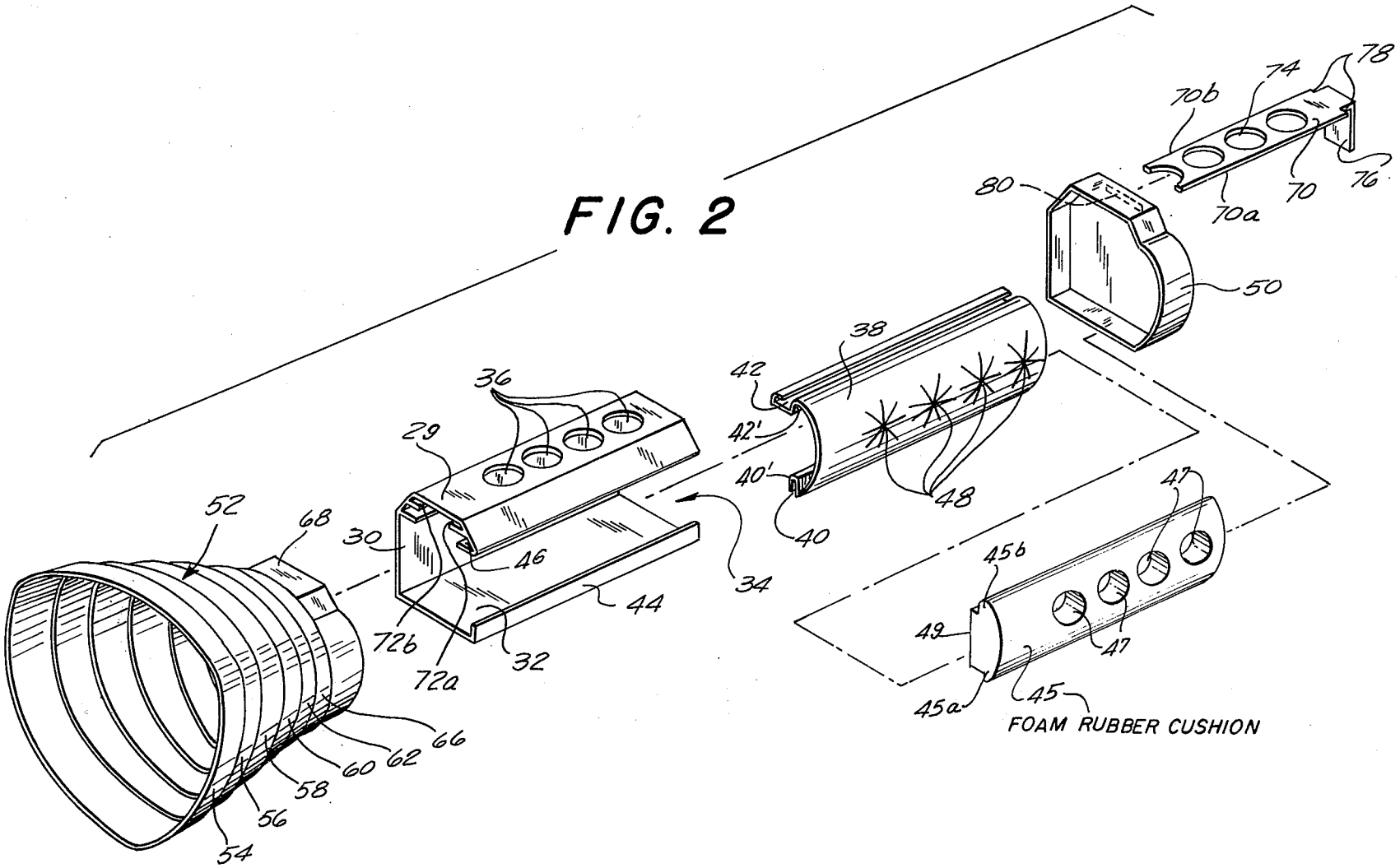
FIG. 2 is an exploded perspective view of the casing which is shown in FIG. 1.

In use the user slips the casing over the connector by first cutting various layers of the cap 52 to the proper terminal length. The parts shown in FIG. 2 are all placed in position. These parts can be factory assembled. Holes are then lined up with set screws with the lid 70 in position exposing the screws. The desired conductors are placed into position such as the conductor 82 in FIG. 1 and the screw is maneuvered by use of allen wrench 84 to maintain the end of the conductor 82 in good electrical and mechanical contact. After this is done the lid 70 is closed.

Figure 5:
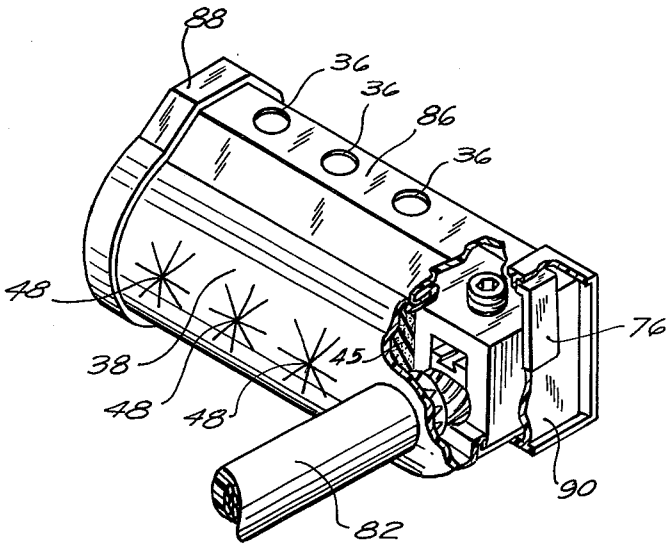
FIG. 5 is a perspective view of an alternate embodiment of the invention.
Figure 4:
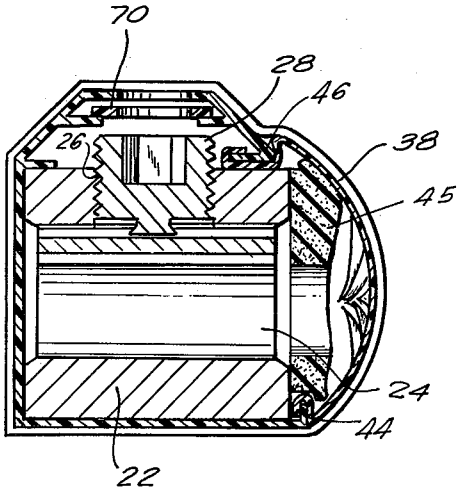
FIG. 4 is a partially sectional view taken along the line 4—4 in the direction of the arrows in FIG. 3.

In FIG. 5 an alternate embodiment of the invention is shown in which the body of the casing is identical to that disclosed in the previous embodiment. However, in this embodiment two end caps or covers similar to the cover 50 of the previous embodiment are used. In FIG. 5 the body of the casing is indicated by the numeral 86 and the covers are indicated by the numerals 88 and 90 respectively. These covers are identical with the exception that one is the mirror image of the other so that either end of the body 86 can be closed by the covers.

What is claimed is:

1. A terminal connector casing including in combination an elongated body, an open side formed in said body through its length, a plurality of through holes provided in said body disposed in alignment longitudinally thereof, an elongated panel attached to said body in the zone of said open side to provide with said body a hollow tubular member, means attaching said panel to said body at the longitudinal edges thereof, a plurality of openings provided in said panel disposed in alignment longitudinally thereof with each opening in the respective transverse plane of one of said through holes, front and rear covers attached to said tubular member at either end thereof and a lid slidably attached thereto, said lid being constructed and arranged in one position thereof to simultaneously cover each of said through holes and a resilient non-conducting cushion within said casing with through openings formed in said cushion which are respectively aligned with said openings in said panel and said cushion being contoured to conform to the inner surface of said panel.

2. A terminal connector casing including in combination an elongated body, an open side formed in said body through its length, a plurality of through holes provided in said body disposed in alignment longitudinally thereof, an elongated panel attached to said body in the zone of said open side to provide with said body a hollow tubular member, means attaching said panel to said body at the longitudinal edges thereof, a plurality of openings provided in said panel disposed in alignment longitudinally thereof with each opening in the respective transverse plane of one of said through holes, front and rear covers attached to said tubular member at either end thereof and a lid slidably attached thereto, said lid being constructed and arranged in one position thereof to simultaneously cover each of said through holes and first and second channel forming portions of said panel respectively providing a first and second outwardly open channels and a resilient non-conducting cushion within said casing with through openings formed in said cushion which are respectively aligned with said openings in said panel and said cushion being contoured to conform to the inner surface of said panel with a rear portion thereof projecting between said channel forming portions.

3. A terminal connector casing in accordance with claim 2 in which said cushion is formed of foam rubber.

* * * * *